US008333271B2

(12) United States Patent
Gibson

(10) Patent No.: US 8,333,271 B2
(45) Date of Patent: Dec. 18, 2012

(54) CONVERTIBLE LUGGAGE

(76) Inventor: Brian D. Gibson, Chicago, IL (US)

( * ) Notice: Subject to any disclaimer, the term of this patent is extended or adjusted under 35 U.S.C. 154(b) by 396 days.

(21) Appl. No.: 12/652,436

(22) Filed: Jan. 5, 2010

(65) Prior Publication Data

US 2011/0108381 A1 May 12, 2011

Related U.S. Application Data

(60) Provisional application No. 61/259,573, filed on Nov. 9, 2009.

(51) Int. Cl.
*A45C 13/20* (2006.01)
*A45C 5/14* (2006.01)

(52) U.S. Cl. ..... 190/18 R; 190/18 A; 190/102; 190/115

(58) Field of Classification Search ..... 190/8, 11, 190/12 A, 18 R, 18 A, 39, 115, 102; 280/37
See application file for complete search history.

(56) References Cited

U.S. PATENT DOCUMENTS

| | | | | |
|---|---|---|---|---|
| 2,729,460 | A * | 1/1956 | Forman | 280/40 |
| 3,156,510 | A | 11/1964 | Hindin et al. | |
| 4,049,091 | A | 9/1977 | Chubb | |
| 4,228,877 | A | 10/1980 | Cothary | |
| 4,262,780 | A * | 4/1981 | Samuelian | 190/18 A |
| 4,574,990 | A * | 3/1986 | Remis | 224/255 |
| 4,966,258 | A | 10/1990 | Hawley | |
| 5,167,306 | A | 12/1992 | Carrigan, Jr. | |
| 5,242,218 | A | 9/1993 | Cota et al. | |
| 5,281,019 | A | 1/1994 | Rodeck | |
| 5,730,282 | A | 3/1998 | Bureau | |
| 5,862,898 | A * | 1/1999 | Chang | 190/115 |
| 5,934,425 | A * | 8/1999 | Sadow | 190/115 |
| 5,988,334 | A * | 11/1999 | Caruso | 190/18 A |
| 6,068,355 | A | 5/2000 | Thorp | |

(Continued)

FOREIGN PATENT DOCUMENTS

EP 1 757 200 2/2007

OTHER PUBLICATIONS

Images of Coleman Roadtrip Grill LXE, available at http://www.coleman.com/coleman/colemancom/detail.asp?product_id=9949-750, last viewed Jan. 5, 2010.

(Continued)

*Primary Examiner* — Sue Weaver
(74) *Attorney, Agent, or Firm* — Beem Patent Law Firm

(57) ABSTRACT

A convertible luggage or storage case having wheels and a telescoping or extending handle that may extend generally linearly from a retracted position to at least one, and preferably a plurality, of extended positions, so that case may be wheeled from one location to another. Handle may include a pair of arms and a cross-piece and also may pivot about an end opposite the cross-piece to form a leg, which may be part of a stand for case. Prior to pivoting, a second leg having a pair of arms and a cross-piece may be located generally coplanar with the handle or first leg, preferably in the interior space between arms. The second leg may pivot at a point between the cross-piece and the opposite end, and an end of the second leg may be located in a groove. As such, the first and second legs may cooperate to form a stand for the case, elevating the case for convenience.

13 Claims, 6 Drawing Sheets

U.S. PATENT DOCUMENTS

| | | | | |
|---|---|---|---|---|
| 6,129,365 | A * | 10/2000 | Sadow | 280/47.26 |
| 6,237,734 | B1 | 5/2001 | Chen | |
| 6,264,047 | B1 | 7/2001 | Crumley | |
| 6,464,245 | B1 * | 10/2002 | Miles | 280/655.1 |
| 6,578,708 | B2 | 6/2003 | Barnett | |
| 6,811,006 | B1 | 11/2004 | Mundle | |
| 6,874,604 | B2 * | 4/2005 | Miller et al. | 190/39 |
| 7,036,641 | B2 | 5/2006 | Russo et al. | |
| 7,051,853 | B2 | 5/2006 | Brown | |
| 7,168,537 | B2 * | 1/2007 | Bellini | 190/115 |
| 7,226,073 | B1 | 6/2007 | Zahiri | |
| 7,318,507 | B2 * | 1/2008 | Fenton et al. | 190/39 |
| 2002/0063072 | A1 | 5/2002 | Pham | |
| 2003/0000785 | A1 * | 1/2003 | Miller et al. | 190/115 |
| 2005/0241900 | A1 * | 11/2005 | Fisher | 190/115 |
| 2007/0278058 | A1 | 12/2007 | Angel | |
| 2010/0263977 | A1 | 10/2010 | Wu | |

OTHER PUBLICATIONS

Images of Walkin' Bag Zipcart 2, Sky Mall magazine.

International Searching Authority (ISA/US), International Search Report mailed Dec. 17, 2010 for International Patent Application PCT/US2010/054974, 3 pages.

* cited by examiner

CONVERTIBLE LUGGAGE

This application claims the benefit of priority from U.S. provisional patent application 61/259,573, filed Nov. 9, 2009.

BACKGROUND OF THE INVENTION

1. Field of the Invention

The present invention is directed to luggage, e.g., rolling luggage, in which a telescoping handle is convertible into a stand for elevating the luggage.

2. Description of the Related Art

Rolling luggage is used by travelers around the world. The combination of wheels and a telescoping handle allows travelers to transport their belongings with a minimum of effort. In addition, bags having these features come in myriad shapes, sizes, and styles, including carry-on compliant luggage, generally rectangular checked luggage, and duffle bags. In addition, the luggage may vary from soft-sided vinyl varieties, to sturdier, hard-sided or molded varieties.

Rolling luggage may provide convenient transport from place to place. However, once users have arrived at a destination, they often leave the case on the ground for emptying or loading. For travelers, some hotels offer luggage racks on which the cases may be set. However, they often only provide one such rack, which is inconvenient for multiple travelers or travelers with multiple cases. Alternatively, travelers may put cases on beds or chairs, but this may transfer dirt from the luggage, e.g., from the wheels or the bottom, to the furniture. In addition, the luggage cannot remain in this location for the duration of the travelers' stay, but instead must be moved in order to use the furniture.

What is needed is luggage that is convenient and that overcomes the drawbacks described above.

BRIEF SUMMARY OF THE INVENTION

In one aspect of the invention, a luggage container, comprising: a wheeled case having a base and a handle, the handle adapted to translate relative to the base and, separately, to rotate relative to the base to form a leg; a second leg adapted to translate with the handle and, separately, to rotate relative to the handle, wherein the legs form a stand for elevating the case. The luggage container further may comprise a channel spaced inward from a back of the base, wherein the channel is adapted to receive at least a portion of the handle and the second leg.

The handle may comprise a pair of arms and a cross-piece, and the second leg may comprise a second pair of arms and a second cross-piece, wherein a width between the pair of arms is greater than a width between the second pair of arms. In addition, the second cross-piece may comprise a depression that creates a gap between the cross-pieces. The case further may comprise a recess spanning a portion of a back and a top of said base, so as to allow the legs to rotate into their standing configuration. The recess may intersect at least one opening into at least one channel, in order to receive the handle and second leg. Moreover, the luggage container may comprise at least one spindle rotatably coupled to the base, wherein the handle and second leg are configured to translate with respect to the spindle and, further wherein the handle is adapted to pivot relative to an axis of rotation of the spindle.

In another aspect of the invention, a luggage container, comprising a storage portion having a plurality of rails disposed proximate a back of the storage portion, and a plurality of spindles disposed proximate ends of the rails and rotatably coupled to the storage portion; a handle having a pair of arms and a cross-piece, wherein the arms are configured to translate within the rails, and further wherein the handle is configured to rotate about axes of rotation of the spindles; a second leg having a second pair of arms and a second cross-piece, the second leg rotatably coupled to the handle, wherein the second pair of arms are configured to translate within the rails, and further wherein the second leg is configured to rotate independently of the handle rotation. The container also may include a groove in the back, the groove configured to receive the second cross-piece. In addition, the storage portion has a top and a bottom, wherein the axes of rotation of the spindles are located a distance from the top, and further wherein the channel is located generally the same distance from the bottom.

The handle may include a limiter disposed on at least one arm, and at least one of the plurality of spindles includes a throughway through which an arm of the handle translates. In addition, the throughway may be adapted to receive the limiter, either partially or wholly within the spindle. The storage portion has a top and further comprises a recess for receiving the handle and second leg, with the recess spanning the top and back of the storage portion. Moreover, the recess may include at least one alcove, wherein at least one of the plurality of spindles is disposed within the alcove.

These and other features and advantages are evident from the following description of the present invention, with reference to the accompanying drawings.

DETAILED DESCRIPTION

Figure 3:
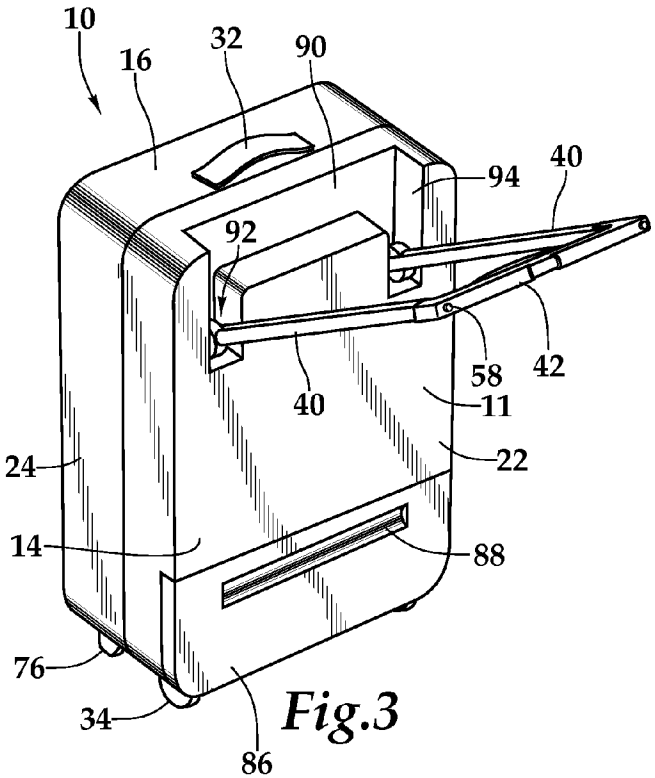
FIG. 3 is a perspective view of the luggage of FIG. 1, having arms in a transitional configuration.

As seen in the various embodiments shown in the figures, with particular reference to FIGS. 1-5, luggage or case 10 may include a base or storage portion 11 having wheels 34 and a telescoping or extending handle 38. Handle 38 may extend generally linearly from a retracted position to at least one, and preferably a plurality, of extended positions, so that case 10 may be wheeled from one location to another. Handle 38 may comprise a pair of arms 40 joined by cross-piece 42.

Handle 38 may pivot about an end opposite cross-piece 42 to form a leg, which may be part of a stand for case 10. Prior to pivoting, a second leg 74 having a pair of arms 76 and a cross-piece 78 may be located generally coplanar with handle or first leg 38, preferably in the interior space between arms 40. In this configuration, cross-piece 78 may include a depression 80, so as to form a hand-hold between cross-piece 42 and cross-piece 78. Depression may be between about 1½" and about 4", preferably about 2½". Second leg 74 may pivot at a point between the cross-piece 42 and the opposite end, e.g., at rivets 84, and an end of second leg 74 may be located in a groove 88. As such, first leg 38 and second leg 74 may cooperate to form a stand for case 10, elevating case 10 for convenience.

Case 10 may include an interior 12 and an exterior 14, with a top 16, bottom 18, front 20, back 22, first side 24, and second side 26. Top 16 may be the surface from which handle 38 extends and may have a fixed handle 32 extending therefrom. Bottom 18 may opposite this, and may be the surface from which wheels 34 and feet 36 extend. Front 20 may be the surface facing upwards when legs are deployed and case 10 is in a stand configuration, and back 22 may be the area from which legs 38, 74 extend.

Case 10 further may include one or more channels in which arms 40, 76 may be stowed. Preferably, case 10 includes a first channel 60 and a second channel 62 spaced apart, each extending from an upper end 66 to a lower end 68. In addition to arms in channels, case 10 may include a recess 90 in which crosspiece 42 and portions of arms may be stowed. Recess 90 may span a width slightly greater than width of cross-piece and may include alcoves 92 extending downward proximate its outer edges through which arms may translate and pivot. In addition, recess 20 may extend across both top 16 and back 22 to allow for rotation of legs 38, 74.

Figure 6:
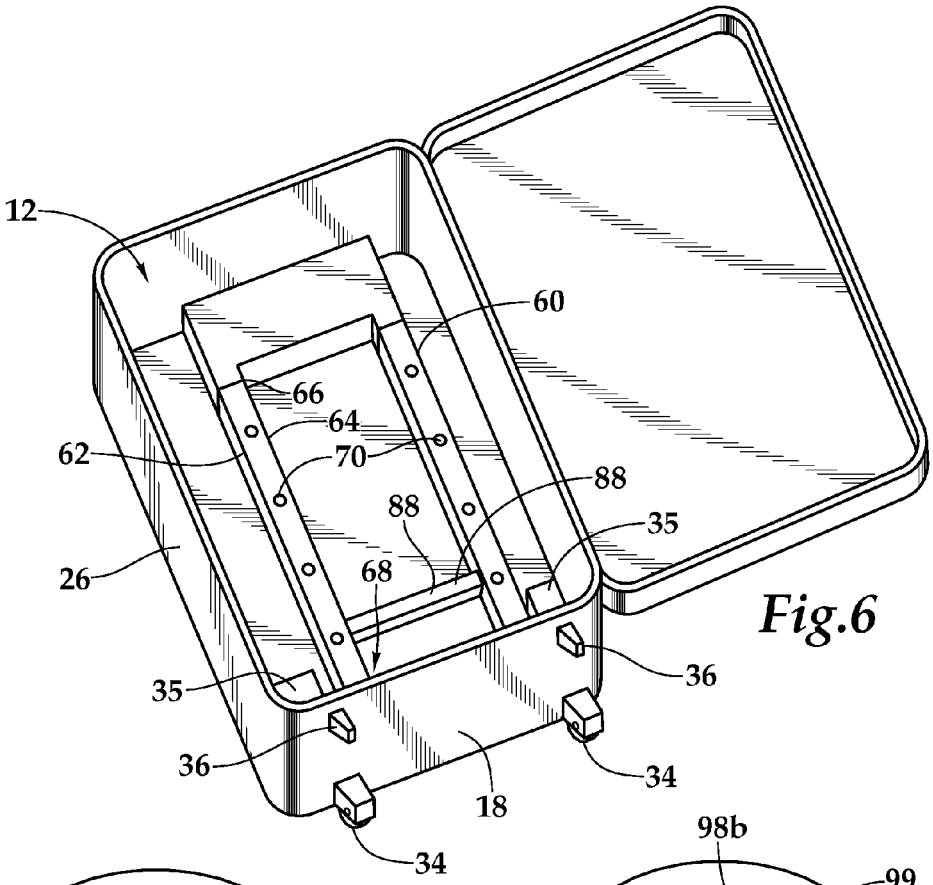
FIG. 6 is a perspective view of the luggage of FIG. 1, with the cover open, displaying the interior.

As seen in FIG. 6, channels 60, 62 may be formed of a hollow tubing 64 secured to interior 12 of case and running along back 22. This configuration may be useful, e.g., when case is soft-sided or has a frame covered in ballistic nylon or another fabric. Channels 60, 62 may be sized to accept arms 40, 76 of both leg 38 and leg 74. Arms 40, 76 may be a generally cylindrical or generally square tubing material that is strong enough to support case 10 and contents but is still light, particularly as many airlines have restrictive weight requirements for luggage. For example, arms may be plastic or a metal such as aluminum or thin steel, having a diameter or side length of about ¾", although other sizes and shapes are possible. Channels 60, 62 may have a length slightly larger than about twice this dimension, and a width slightly larger than this dimension, to account for arms 40, 76 being disposed side-by-side.

In another embodiment, base 28 may be molded, and channels 60, 62, recess 90, and alcoves 92 may be molded into base 28 to form a unitary piece. In still another embodiment, a single recess and channel may span a width at least as wide as cross-piece 42 of handle 38, so that both arms 40 of first leg 38 and both arms 76 of second leg 74 may be disposed within single channel when legs are stowed. In this embodiment, case 10 may not include alcoves 92.

Leg 38 and second leg 74 may be sized to allow for a slight interference fit so as to keep second leg 74 from rotating relative to leg 38 when leg 38 is in a translated, handle configuration. Interference fit may be achieved in a variety of ways, including, e.g., sizing outer width between arms 76 slightly greater than inner width of arms 40, sizing outer height of cross-piece 78 slightly greater than inner height of cross-piece 42, or adding interfacing ridges, latches, dimples and recesses, or similar structures to arms 40, 76 and/or cross-pieces 42, 78.

Although cross-piece 78 may include a depression 80 to provide clearance for a user's hand to grasp cross-piece 42, users may elect to hold cross-piece 78 when pulling case 10. In order to prevent second leg 74 from rotating relative to leg 38 in these cases, e.g., by applying a rotational force only to second leg 74, leg 38 may include corner pieces 44 between cross-piece 42 and arms 40. Corner pieces 44 may include flanges 46 on the sides of cross-piece 42 and/or arms 40 closer to front 20 of case 10, with corner pieces 44 extending inward. Flanges 46 may engage cross-piece 78 and/or arms 76 of second leg 74, preventing the unwanted rotation of second leg 74.

Leg 38 may include a releasing mechanism 48 disposed within the leg, which may include an actuator 50 for moving leg 38 translationally from one position to another. Releasing mechanism 48 may include one or more locking pins or bullet stoppers 52 protruding from openings 54 in arms 40. Pins 52 may engage openings 70 in channels 60, 62, preventing leg 38 from extending. Actuator 50 may cause pins 52 to retract, allowing leg 38 to translate along channels 60, 62 from a stored position to one or more extended positions, where pins 52 may engage additional openings, locking legs 38, 74 in place so that they may be used as a handle for guiding case 10 when rolling.

Figure 7:
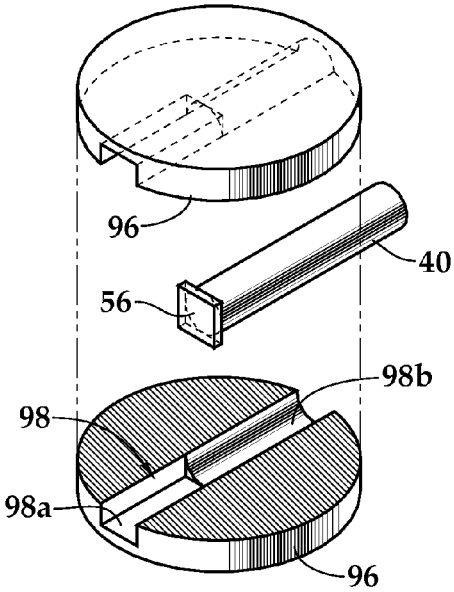
FIG. 7 is an exploded, sectional view of one embodiment of a spindle.
Figure 8:
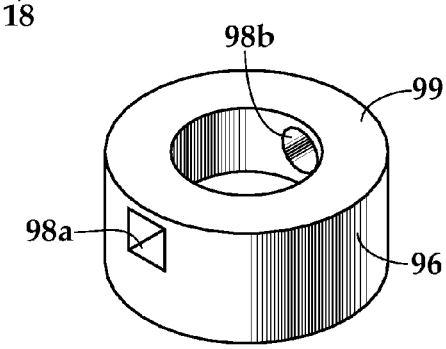
FIG. 8 is a perspective view of a second embodiment of a spindle.
Figure 9:
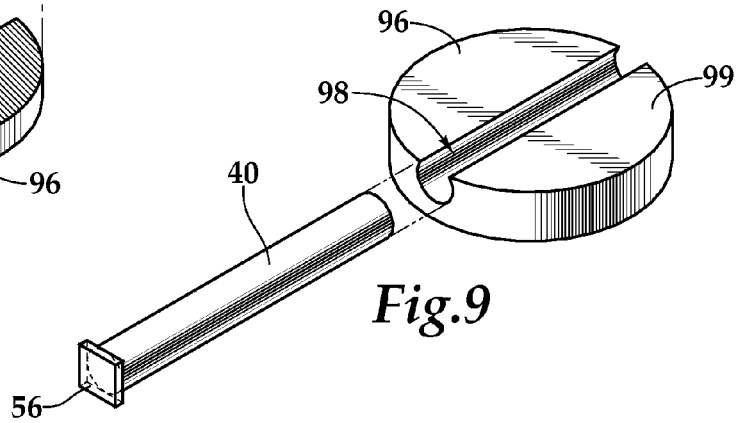
FIG. 9 is a perspective view of a third embodiment of a spindle.

Arms 40 of leg 38 may operatively engage spindles 96, such as those seen in FIGS. 7-9. Spindles 96 may be generally cylindrical or disc-shaped. In one embodiment, spindle 96 may be rotationally mounted to sidewall 94 of alcove 92, for example by riveting through center of spindle 96. In another embodiment, spindle 96 may comprise a plurality of smaller cylinders with an open space therebetween, with ends of arms 40 located within that gap and rotationally coupled to spindles 96. In this embodiment, spindles 96 may translate with arms 40 within channels 60, 62 or within a single, combined channel.

Spindles allow for both translational movement of arms 40 so that leg 38 may serve as a handle for rolling case 10 and rotational movement of arms 40 so that leg 38 may become one part of a stand for case 10. One way in which this dual function may be accomplished may be through the formation of a throughway 98 passing through spindle, e.g., in a direction generally normal to axis of rotation. In one embodiment, throughway 98 may be offset from axis of rotation in order to provide clearance between throughway and rivet. In another embodiment, as seen in FIG. 8, spindle 96 may include a countersunk portion extending inward from an outer surface 99, and rivet may extend outward only as far as bottom of countersunk portion. In this case, throughway may pass through axis of rotation at an axial distance between outer surface 99 and bottom of countersunk portion.

Throughway 98 may have a cross-section larger than cross-section of arm 40 to allow arm to translate through throughway 98. Throughway 98 may be completely bounded within spindle 96, or throughway 98 may intersect outer surface 99 such that throughway 98 may be accessible from outer surface 99. For example, if arm 40 has a generally circular cross-section, throughway may have a generally circular cross-section if uninterrupted, or it may have a crescent shaped cross-section if its perimeter intersects outer surface 99. In this latter case, as seen in FIG. 9, preferably less than half of throughway 98 intersects outer surface 99, which may aid in restricting lateral movement of arms to the directions in line with throughway 98 and prevent arms from slipping out of throughway 98. In these embodiments, arms 76 of second leg 74 may translate alongside and external to spindle 96. These embodiments may be preferred because they do not require feet 82 of second leg 74 to clear throughway 98 in order for second leg 74 to rotate relative to first leg 38. As such, second leg may be made slightly longer, which may improve stability of case 10 or may allow case 10 to be elevated slightly higher when in a stand configuration.

In another embodiment, throughway 98 may be sized to accommodate both first leg 38 and second leg 74. In this embodiment, second leg 74 should be sized so that feet 82 pass completely through spindle 96 when handle 38 is fully extended, prior to rotating handle 38.

Case 10 may include features that establish a maximum translationally extended position of handle 38. For example, ends of arms 40 opposite cross-piece 42 may include or be coupled to limiters 56, such as plugs or nuts, which may extend rearward from arms 40 and may be sized larger than cross-sectional perimeters of arms 40. As arms 40 are extended, limiters 56 may translate within channels 60, 62 until they encounter spindle 96. If limiters 56 are sized larger than cross-sectional perimeter of throughway 98, throughway will inhibit further translational motion, thereby establishing a maximum extended position of handle 38.

In the embodiment described above, alcoves 92 preferably extend inward from back a distance larger than the combined depth of spindle 96 and limiter 56. As such, case 10 will have sufficient clearance for limiter 56 to rotate when handle is rotated to form leg 38, while also allowing spindle 96 to be disposed completely within alcove 92.

In another embodiment, throughway 98 may have a plurality of differently-shaped cross-sections. Turning to FIG. 7, for example, throughway 98 may have a first cross-section 98*a* sized and shaped to admit passage of arm 40 and limiter 56, and a second, smaller cross-section 98*b* sized and shaped to admit passage arm 40 but not limiter 56. Here, arm 40 may translate until limiter 56 contacts intersection of first cross-section 98*a* and second cross-section 98*b*. This embodiment may allow alcove 92 to be shallower, since additional clearance for limiter 56 may not need to be created, which in turn may increase the available volume of the interior 12 of case 10 for storage purposes.

Legs 38, 74 and spindles 96 may be located to provide a stable base when case 10 is in a stand configuration. Preferably, arms 40, 76 of legs may be spaced as far apart from each other as possible, i.e., proximate sides 24, 26 of case 10. For example, arms 40 may be spaced about 1½" from sides 24, 26. This may allow sufficient clearance between sidewalls 94 of alcoves 92 and sides 24, 26 to fasten spindle 96 to sidewall 94. In addition, this distance may allow sufficient spacing at back 22 of case 10, proximate bottom 18 for both wheels 34 and channels 60, 62, since bottom 18 of case may include wheel wells 35 to partially recess wheels 34. In addition to creating a more stable platform for case 10 when in a stand configuration, this spacing may maximize the distance between arms 76 of second leg 74, which may provide for a larger, continuous interior space for storing items in case 10.

Figure 2:
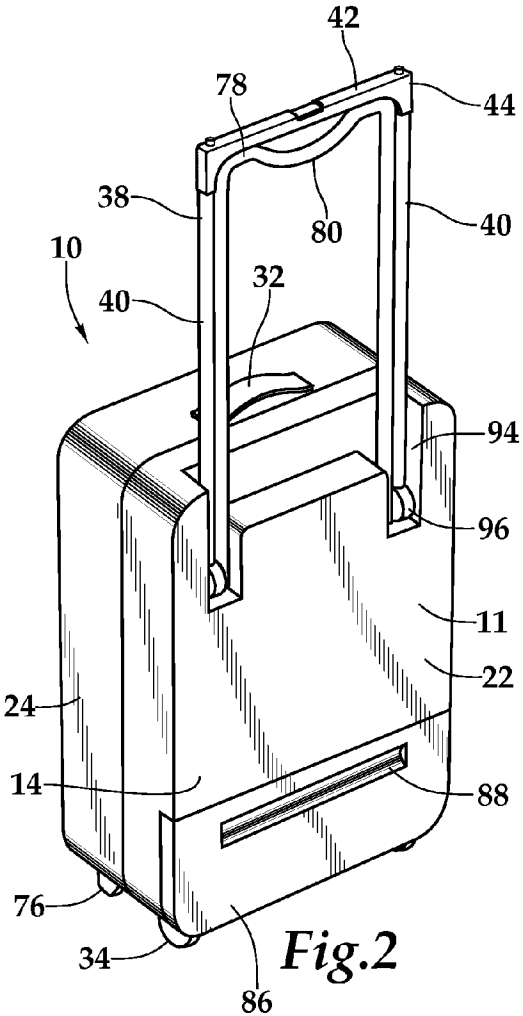
FIG. 2 is a perspective view of the luggage of FIG. 1, having arms in an extended configuration.
Figure 1:
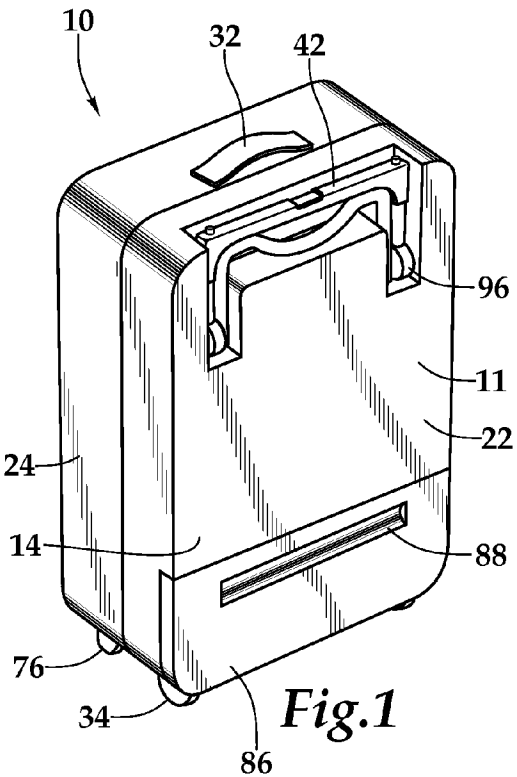
FIG. 1 is a perspective view of a convertible piece of luggage having arms in a stowed configuration.
Figure 5:
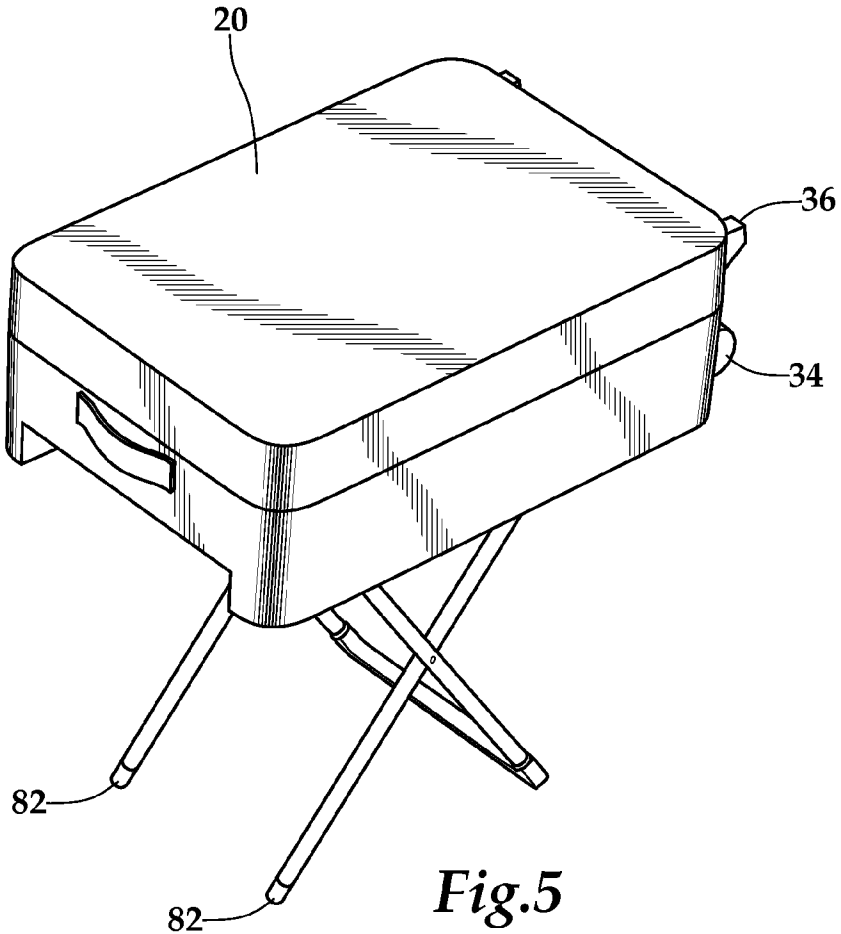
FIG. 5 is a second perspective view of the luggage of FIG. 1 in which the arms are in a standing configuration.
Figure 4:
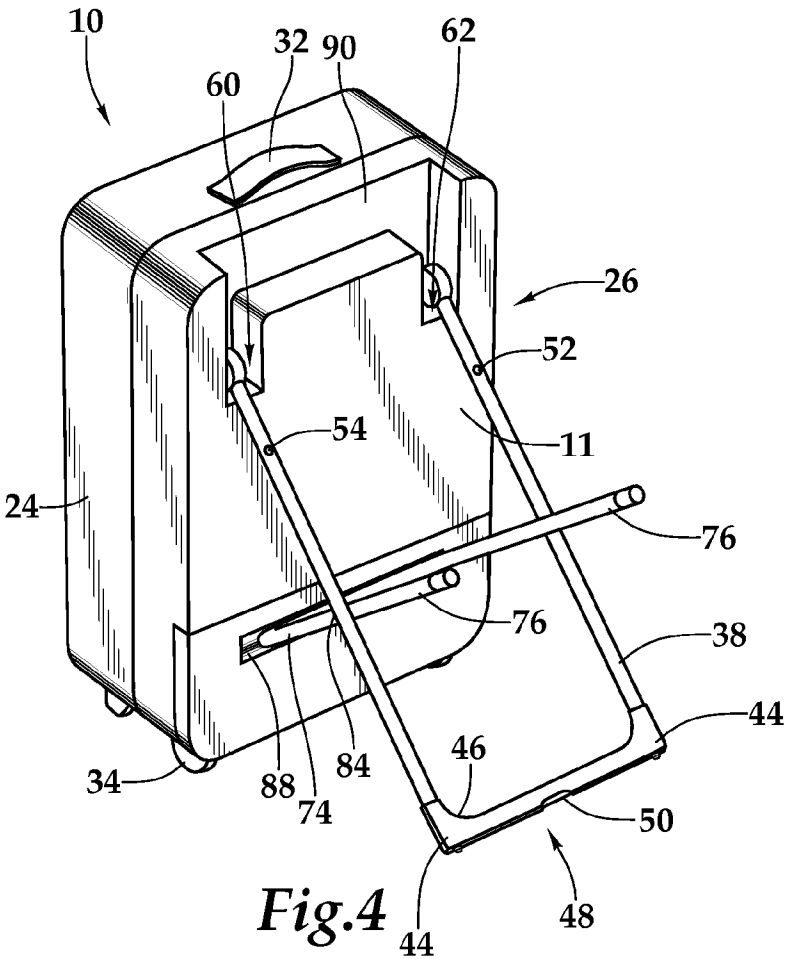
FIG. 4 is a perspective view of the luggage of FIG. 1, having arms in a standing configuration.

To convert case 10 from a rolling to a standing configuration, back 22 may include a groove 88 generally centered along width of back 22 and having a width at least as large as width of cross-piece 78. Once fully extended, as seen in the progression of FIGS. 2-4, first leg 38 may be rotated about spindles 96. Separately, or concurrently, second leg may be rotated about a pivot point at rivets 84 so that cross-piece is inserted in groove 88. At this point, legs 38, 74 may cross, with their arms forming an X-shape. Cross-piece 42 of leg 38 and distal ends 77 of arms 76 may rest on the ground to provide the base of the stand. In addition, distal ends 77 of arms 76 may include feet 82, which may be rubberized or plasticized to prevent skidding, scratching, or other marring of the surface on which case 10 is placed. Similarly, outer surface of cross-piece 44 of first leg 38 may include knobs or protrusions 58, which also may be rubberized or plasticized, and which may be molded into cross-piece or coupled thereto, may serve similar anti-skidding, scratching or marring functions. In addition, protrusions 58 may elevate cross-piece from resting surface slightly, which also may elevate actuator 50 and may help alleviate wear and tear on actuator.

Groove 88 may be provided in various ways. For example, if back 22 of case 10 is molded, groove 88 may be molded directly into case. Alternatively, if back is soft-sided, e.g., made of ballistic nylon, groove 88 may be formed in a plate 86. An opening sized to receive plate 86 may be formed in the back 22, and plate may be coupled to the back, e.g., via an adhesive, via stitching through both back 22 and plate 86, or via other fasteners. In still another embodiment, case 10 may include molded corners such as molded wheel wells 35 proximate intersections of bottom 18, back 22, and sides 24, 26. Plate 86 and corners may be molded into a unitary piece spanning a width of case 10, with this piece coupled to the case, e.g., using one of the techniques described above. Plate 86 may extend outward slightly from back 22, such as when plate 86 rests on back 22. However, plate 86 preferably lies generally flush with back 22 so that groove 88 extends inward from back 22.

The distance between spindles 96 and top 16, and between groove 88 and bottom 18, may be selected so as to balance stability of the stand with the height of case 10 when in a standing configuration. The closer spindles 96 and groove 88 are to top 16 and bottom 18, respectively, the wider legs 38, 74 will be, and the more stable case 10 may be. However, this increased spread also means that case 10 will be closer to the ground. Conversely, moving spindles 96 and groove 88 inward may raise case 10, but may bring feet 82 and cross-piece 42 closer together, reducing stability. In one embodiment, legs 38, 74 may form an angle with back 22 between about 30 degrees and about 80 degrees, preferably between about 40 degrees and about 70 degrees, still more preferably about 55 degrees.

When in a standing configuration, case 10 preferably is generally level, and feet 36 and cross-piece 42 may be spaced between about 12" and about 20" apart. To accomplish this, legs 38, 74 preferably may be similar in length, although second leg 74 may be shorter than leg 38. However, this disparity may be overcome in several ways. For example, groove 88 may be shallower than the distance that spindle 96 is recessed from back. Additionally, or alternatively, groove 88 may be spaced inward from bottom 18 slightly more than spindle 96 is spaced from top 16. Moreover, while legs 38, 74 preferably are coupled near midpoints of arms 40, 76, this coupling location may be adjusted to compensate for a disparity in leg length.

Preferably, however, legs 38, 74 may have generally similar lengths. For a case having a height of about 25½", leg 38 may have a length of about 24⅞", second leg 74 may have a length of about 24⅛", and pivot point may be about 12½" from proximal end of leg 38. In addition, spindles 96 and groove 88 may be generally equally spaced from top 16 and bottom 18, respectively, and this spacing may be between about 3½" and about 7½", preferably about 5½". This may result in back 22 of case 10 being elevated about 19" off ground, and cause feet 36 and cross-piece 42 to be spaced about 16" apart.

Case 10 having the configuration described above may yield one-piece, convertible luggage that has utility as both rolling luggage with an extending and retracting handle and as elevated luggage with a stand for easier access to luggage contents. By integrating stand into case, a user may always have the option of using the stand without having to worry about losing or forgetting it. In addition, by having the handle double as one of the legs for the stand, fewer parts may be needed, saving weight for the user, thereby allowing the user to add more items to the case while staying under the weight limits prescribed by many airlines. Moreover, the internal configuration of channels inside the case may serve to protect the legs from damage, e.g., from baggage handlers, conveyor belts, or other bags.

Figure 12:
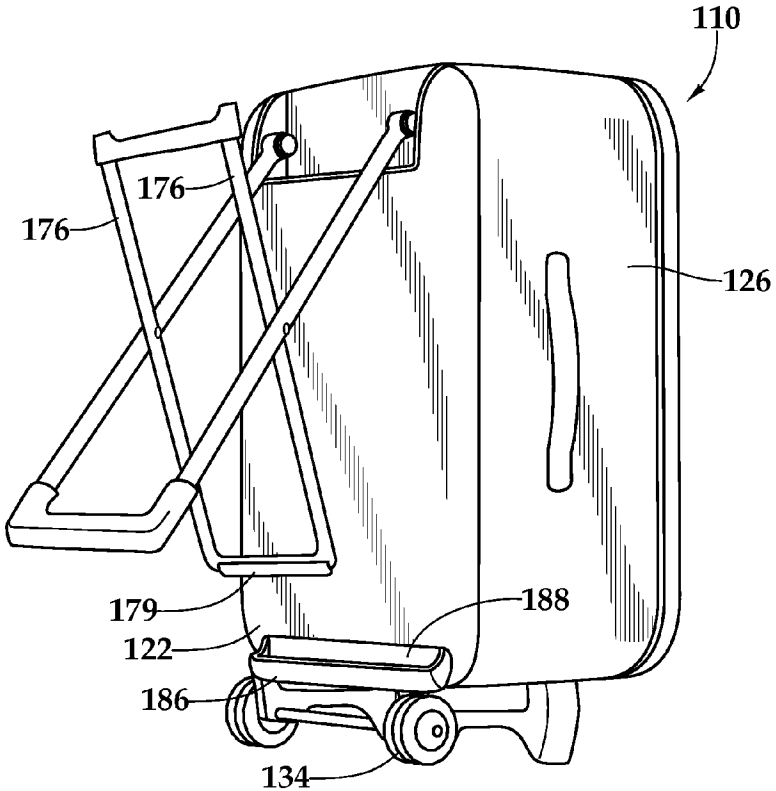
FIG. 12 is a perspective view of the luggage of FIG. 10, having arms separated and moving into a standing configuration.
Figure 10:
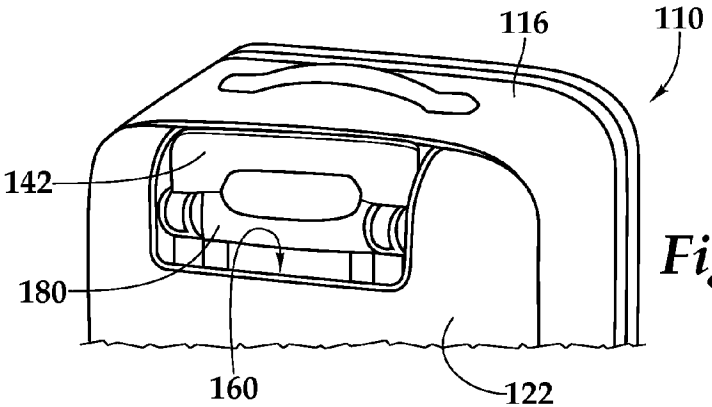
FIG. 10 is a partial perspective view of a second embodiment of a convertible piece of luggage, having arms in a stowed configuration.
Figure 11:
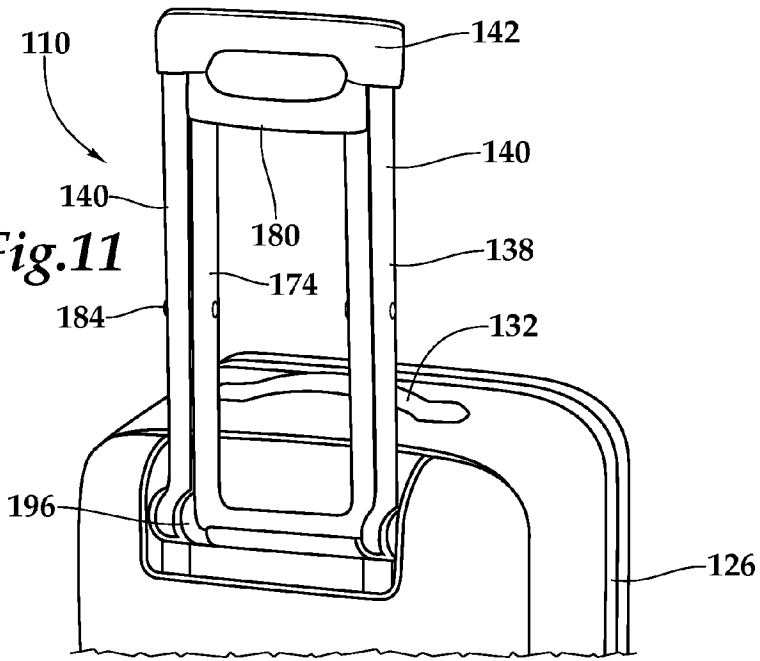
FIG. 11 is a partial perspective view of the luggage of FIG. 10, having arms in an extended configuration.
Figure 16:
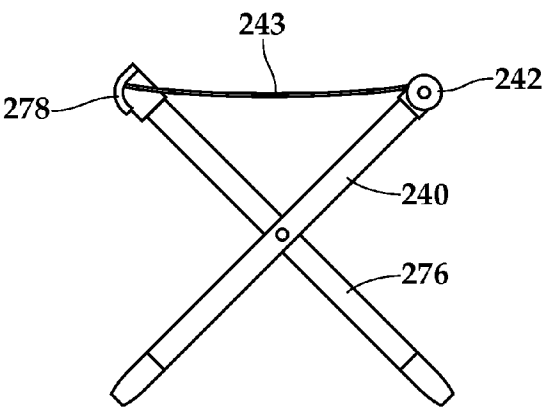
FIG. 16 is a side view of the arms of the luggage of FIG. 13, shown in an expanded configuration.

Turning to FIGS. 10-12, another embodiment of a case 110 is shown. In this embodiment, distal ends 177 of arms 176 of second leg 174 may be joined by a second cross-piece 179. In order to accommodate this cross-piece 179, case 10 may include a single channel 160 wider than an outside width of leg 138. In this embodiment, plate 186 with groove 188 may be spaced rearward from back. However, as described with respect to the first embodiment described above, plate 186 preferably may be generally flush with back 122, which may allow for easier transport of case 110, such as during loading and unloading into airplane overhead bins.

In this embodiment, spindles 196 may be fixedly coupled to channel 160. Alternatively, spindles may translate with legs 138, 174, e.g., along rails disposed within channel 160. In the latter case, leg 138 may be rotationally coupled to spindles 196, and spindles may include limiters 156 to determine a maximum translational extent of leg 138. For example, limiters 156 may be surfaces of spindles 196 that contact ends of channel 160 or rails in channel 160.

Turning to FIGS. 13-18, a third embodiment of a case 210 is shown. In this embodiment, as compared to the coupled or unitary embodiments described above, legs 238, 274 may be completely releasable from base 228. Leg 238 may include a releasing mechanism 248 similar to the mechanism 48 described above. Alternatively, base 228 may include one or more latches 249 proximate intersection of top 216 and back 222. Latches 249 may open and close, whereby opening latch creates clearance between legs 238, 274 and channels 260, 262, allowing legs to extend to create a handle or to be removed to create a stand. Similarly, closing latch shrinks the opening into channels 260, 262, causing an interference fit with legs 238, 274, thereby preventing their translation. In the embodiment shown, legs 238, 274 may be generally rectangular or square, forming another rectangle when placed side-by-side, and openings into channels may be similarly-shaped rectangles.

Feet 282 of legs also may be generally rectangular, but preferably are aligned where they meet or intersect and taper towards distal ends on the sides opposite this intersection. In addition, feet 282 may taper inward on front and back sides. Tapering may serve at least two purposes, including allowing feet 282 to insert more easily into channels 260, 262 and increasing surface contact area when in a stand configuration to create a more stable platform.

Figure 18:
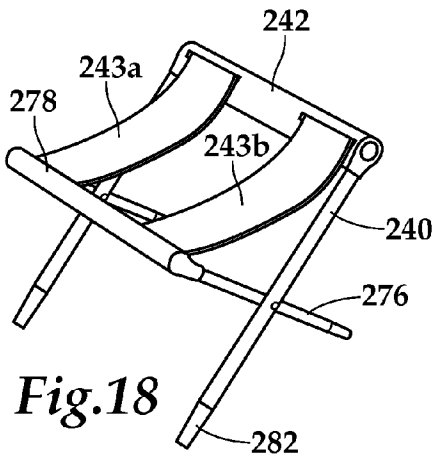
FIG. 18 is a perspective view of a second version of the arms used with the luggage of FIG. 13, the arms having a plurality of belts between them.
Figure 15:
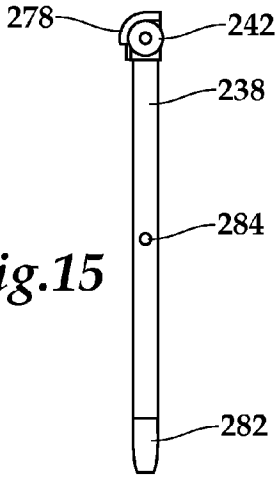
FIG. 15 is a side view of the arms of the luggage of FIG. 13, shown in a collapsed configuration.
Figure 17:
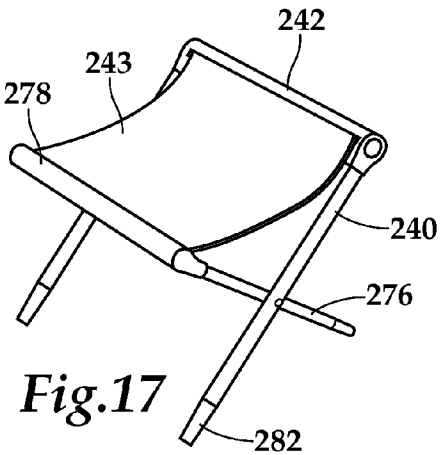
FIG. 17 is a perspective view of one version of the arms used with the luggage of FIG. 13, the arms having a single belt between them.
Figure 13:
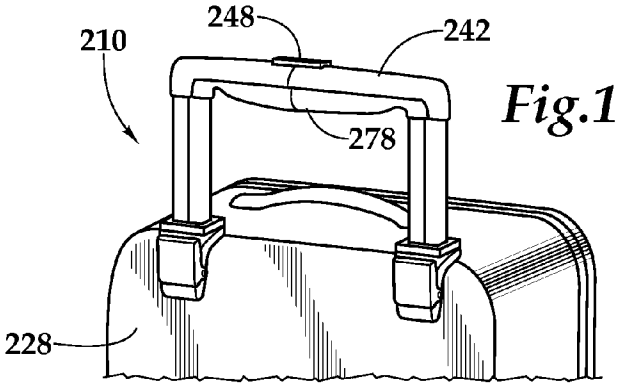
FIG. 13 is a partial perspective view of a third embodiment of a convertible piece of luggage, having arms in a partially extended position.
Figure 14:
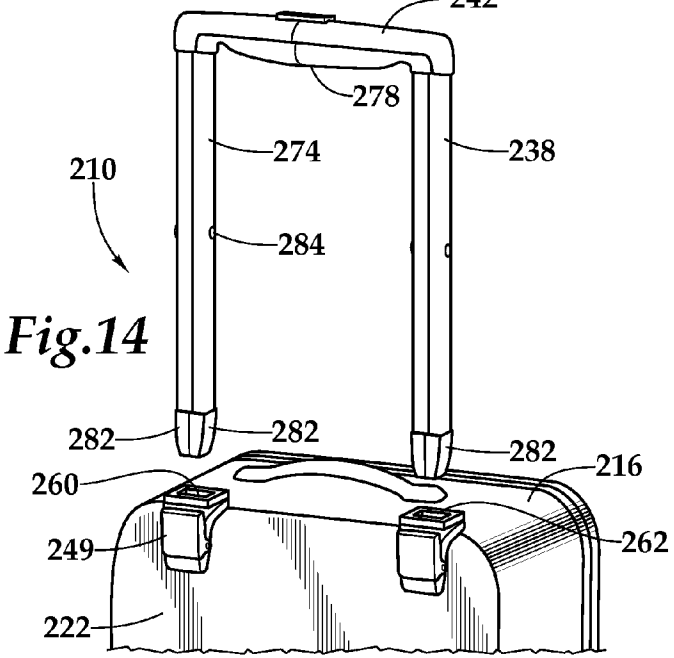
FIG. 14 is a partial perspective view of the luggage of FIG. 13, having arms separated completely from a base portion.

In this embodiment, cross-pieces 242, 278 may include one or more embedded retractable belts 243. One end of belt(s) may be fixedly coupled to one cross-piece, the second end may be fixedly coupled to the other cross-piece, and the length between the ends may retractably coil inside one of the cross-pieces. As can be seen in FIG. 17, a single belt 243 may span substantially the width of cross-pieces. Alternatively, as seen in FIG. 18, multiple, narrower belts 243*a*, 243*b* may be included, with gaps between the belts. In either case, when legs 238, 274 are separated, belts may extend, providing a surface on which case 210 may rest and/or providing sufficient tension between cross-pieces 242, 278 to prevent legs 238, 274 from collapsing.

Figures 19, 20, 21:
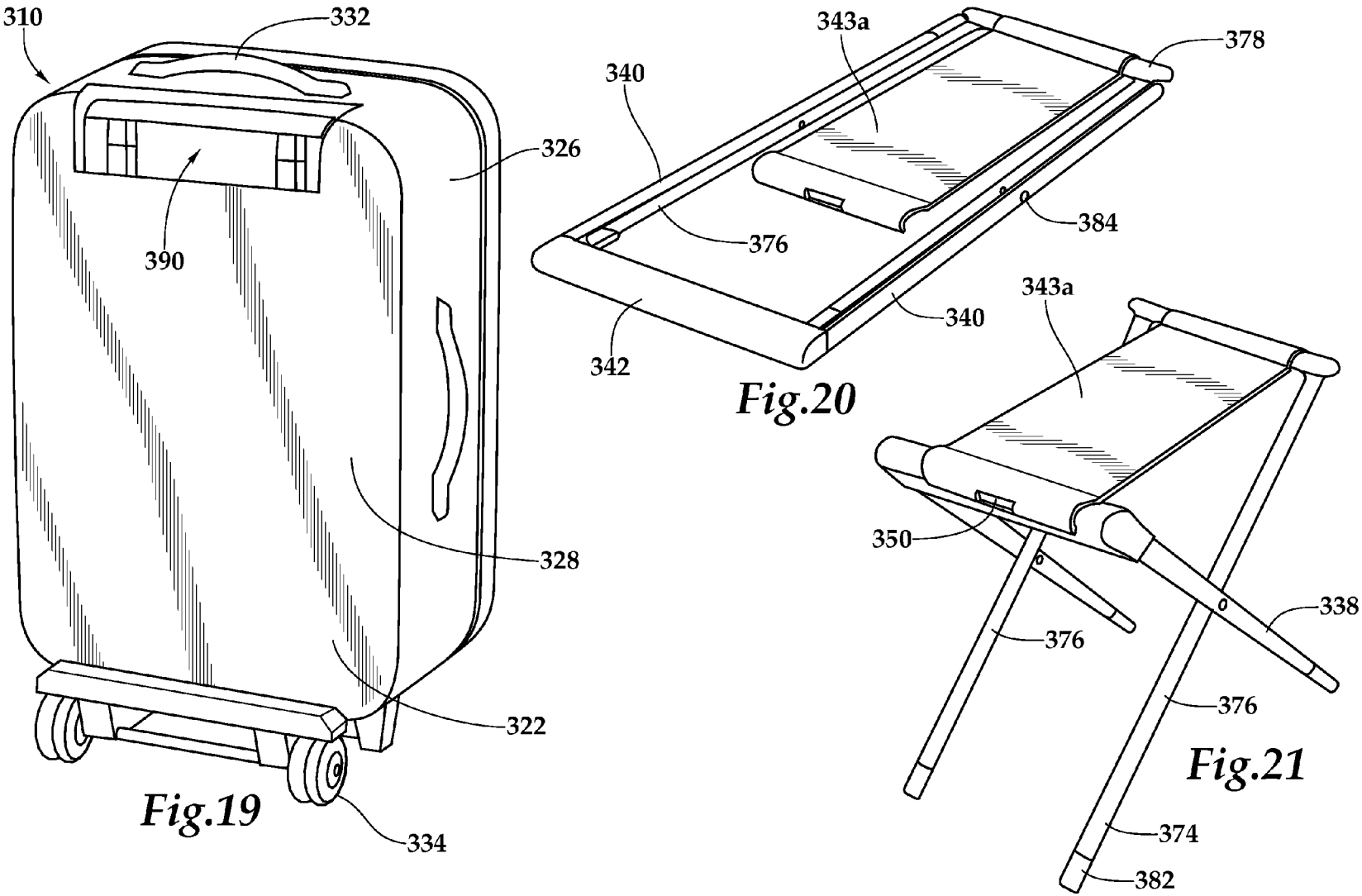
FIG. 19 is a perspective view of a fourth embodiment of a convertible piece of luggage.
FIG. 20 is a perspective view of the arms used with the luggage of FIG. 19, shown in a collapsed configuration.
FIG. 21 is a perspective view of the arms used with the luggage of FIG. 19, shown in an expanded configuration.

Turning now to FIGS. 19-21, a fourth embodiment of case 310 is shown. Like the third embodiment, legs 338, 374 may be completely separable from base 328. Instead of retractable belts embedded in cross-piece, a solid plank 345 may be rotationally coupled to one of cross-pieces 342, 378. Plank 345 may be a unitary, rigid piece, e.g., made of an injection molded plastic. Plank 345 may include a hook or overturned portion at a free end for releasably coupling to the other cross-piece. In addition, hook may include a gap, e.g., centrally located, to allow clearance for actuator 350.

As shown in the figures, when collapsed, cross-pieces 342, 378 may be opposite one another, with feet of one leg next to a cross-piece of the other leg. This configuration may allow legs to be substantially the same length, which may result in a level base for the stand.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment and method, but by all embodiments and methods within the scope and spirit of the invention as claimed.

What is claimed is:

1. A luggage container, comprising:

a case having a wheeled base and a handle, said handle comprising a first leg and a second leg;

said wheeled base including a plurality of channels, each channel configured to receive a portion of said first leg and a portion of said second leg;

said first and second legs adapted to translate relative to said base;

said first and second legs coupled to but completely separable from said base;

wherein, when separated from said base, said first leg and said second leg are rotatable with respect to one another and configured to form a level stand to hold said case.

2. A luggage container according to claim 1, each channel having an opening proximate a back or a top of said base.

3. A luggage container according to claim 2, wherein each channel is spaced at least one of inward from said back or said top.

4. A luggage container according to claim 2, further comprising a recess spanning a portion of said back and said top of said base.

5. A luggage container according to claim 4, wherein said recess intersects at least one opening into at least one channel for receiving said first leg and said second leg.

6. A luggage container according to claim 1, said first leg comprising a pair of arms and a cross-piece, and said second leg comprising a second pair of arms and a second cross-piece, wherein a width between said pair of arms is greater than a width between said second pair of arms.

7. A luggage container according to claim 6, said second cross-piece comprising a depression to create a gap between said cross-piece and said second cross-piece.

8. A luggage container according to claim 1, wherein said base has an interior and an exterior and a plurality of sides;

wherein each channel has an opening allowing passage to said exterior;

said container further comprising a recess in said exterior, said recess spanning portions of at least two adjacent sides.

9. A luggage container according to claim 8, wherein one of said plurality of channels is generally parallel to another of said plurality of channels.

10. A luggage container according to claim 1, wherein said first leg comprises a plurality of arms and a cross-piece connecting distal ends of said plurality of arms, said second leg comprises a second plurality of arms and a second cross-piece connecting distal ends of said second plurality of arms, and further wherein said cross-piece is longer than said second cross-piece.

11. A luggage container according to claim 1, further comprising a releasing mechanism, said releasing mechanism configured to permit translational adjustment of said handle among a plurality of positions relative to said base.

12. A luggage container according to claim 11, said releasing mechanism comprising one or more pins configured to engage a plurality of openings to position said handle at a desired position and further configured to retract to permit translation of said handle.

13. A luggage container according to claim 1, the first and second legs each comprising a pair of arms with a cross-piece therebetween;

the luggage container further comprising a recess spanning a portion of a back and a top of said base;

wherein the recess is configured to receive said first and second leg cross-pieces when said handle is in a stored configuration.

* * * * *